US009233830B2

(12) United States Patent
Braun

(10) Patent No.: US 9,233,830 B2
(45) Date of Patent: Jan. 12, 2016

(54) PIVOTING STIRRUP SYSTEM

(71) Applicant: Roger J. Braun, Barney, ND (US)

(72) Inventor: Roger J. Braun, Barney, ND (US)

( * ) Notice: Subject to any disclaimer, the term of this patent is extended or adjusted under 35 U.S.C. 154(b) by 36 days.

(21) Appl. No.: 14/247,462

(22) Filed: Apr. 8, 2014

(65) Prior Publication Data

US 2015/0284238 A1 Oct. 8, 2015

(51) Int. Cl.
*B68C 3/02* (2006.01)

(52) U.S. Cl.
CPC ..... *B68C 3/02* (2013.01)

(58) Field of Classification Search
CPC .... B68C 3/02; B68C 3/00; B68C 2003/0058; B68C 2003/005; B68C 3/025; B68C 2003/0008; B68C 3/0016; B68C 2003/0025; B68C 2003/0033; B68C 2003/0041; B68C 2003/0066; B68C 2003/0075; B68C 2003/0083; B68C 2003/0091
See application file for complete search history.

(56) References Cited

U.S. PATENT DOCUMENTS

| | | | | | |
|---|---|---|---|---|---|
| 49,103 | A | * | 8/1865 | Gould | 54/49 |
| 83,450 | A | * | 10/1868 | Bond | 54/49 |
| 143,732 | A | | 10/1873 | Thompson | |
| 368,193 | A | * | 8/1887 | Collins | 54/49 |
| 408,944 | A | | 8/1889 | Welcome | |
| 567,334 | A | * | 9/1896 | Chilcott | 54/47 |
| 807,000 | A | * | 12/1905 | Southworth | 54/48 |
| 884,197 | A | | 4/1908 | Motigue | |
| 908,265 | A | * | 12/1908 | Ivey | 54/49 |
| 1,065,438 | A | | 6/1913 | Fiandt | |
| 1,352,406 | A | * | 9/1920 | Green | 54/49 |
| 2,772,532 | A | * | 12/1956 | Tann | 54/49 |
| 3,276,185 | A | | 10/1966 | Jahn | |
| 3,423,904 | A | | 1/1969 | Stubblefield | |
| 3,927,509 | A | * | 12/1975 | Riebold | 54/48 |
| 4,869,053 | A | * | 9/1989 | Bradford et al. | 54/49 |
| 5,979,149 | A | | 11/1999 | Martin | |
| 6,026,633 | A | | 2/2000 | Burke, Jr. | |
| 6,173,558 | B1 | * | 1/2001 | Burke, Jr. | 54/47 |
| 6,330,781 | B1 | | 12/2001 | Meroth | |
| 6,898,924 | B1 | * | 5/2005 | McCoy | 54/49 |
| 7,287,362 | B1 | * | 10/2007 | Ford | 54/47 |
| 7,543,427 | B2 | | 6/2009 | Strauss | |
| 2009/0178375 | A1 | * | 7/2009 | Benetti | 54/49 |

FOREIGN PATENT DOCUMENTS

| | | | | |
|---|---|---|---|---|
| FR | 339248 | * | 2/1905 | B68C 3/00 |
| FR | 427793 | * | 8/1911 | B68C 3/02 |

* cited by examiner

*Primary Examiner* — Kathleen Alker
(74) *Attorney, Agent, or Firm* — Neustel Law Offices

(57) ABSTRACT

The pivoting stirrup system includes a foot support having a rear end, a front end, a first sidewall extending upwardly from a first side of the foot support and a second sidewall extending upwardly from a second side of the foot support, a first member pivotally connected to the first sidewall and a second member pivotally connected to the second sidewall. The first member and the second member are pivotally connected to a forward portion of the respective sidewalls. A first fastener extends through the first member and the first sidewall with a first bushing positioned upon the first fastener and a second fastener extends through the second member and the second sidewall with a second bushing positioned upon the second fastener.

17 Claims, 9 Drawing Sheets

PIVOTING STIRRUP SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a stirrup and more specifically it relates to a pivoting stirrup system for increasing the comfort and safety for a rider.

2. Description of the Related Art

Any discussion of the related art throughout the specification should in no way be considered as an admission that such related art is widely known or forms part of common general knowledge in the field.

Saddles typically include a pair of stirrups for a rider of an animal (e.g. horse). The rider uses the stirrups for mounting the animal, support during riding and for dismounting the animal. Conventional stirrups are comprised of a foot support having a pair of support members extending upwardly from the foot support forming a U-shaped structure that is pivotally attached at an upper end to a strap that is attached to the saddle.

One of the problems with conventional stirrups is that the foot support is relatively narrow from front to back making them uncomfortable for riders over extended periods of time. Another problem is that the foot support of the stirrup itself does not pivot during mounting, riding or dismounting thereby making it difficult to mount and dismount along with uncomfortable for extended periods of riding since the foot support has little movement, if any, with respect to the support members that extend upwardly to the strap of the saddle. Another problem encountered by riders with conventional stirrups is that during dismounting the animal their foot may get caught in the stirrup since the foot support portion of the stirrup does not pivot resulting in physical harm to the rider particularly if the animal moves forwardly during the dismount.

Because of the inherent problems with the related art, there is a need for a new and improved pivoting stirrup system for increasing the comfort and safety for a rider.

BRIEF SUMMARY OF THE INVENTION

The invention generally relates to a stirrup which includes a foot support having a rear end, a front end, a first sidewall extending upwardly from a first side of the foot support and a second sidewall extending upwardly from a second side of the foot support, a first member pivotally connected to the first sidewall and a second member pivotally connected to the second sidewall. The first member and the second member are pivotally connected to a forward portion of the respective sidewalls. A first fastener extends through the first member and the first sidewall with a first bushing positioned upon the first fastener and a second fastener extends through the second member and the second sidewall with a second bushing positioned upon the second fastener. The bushings are comprised of a resilient material to provide for a controlled and smooth pivoting motion of the foot support with respect to the first member and second member.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
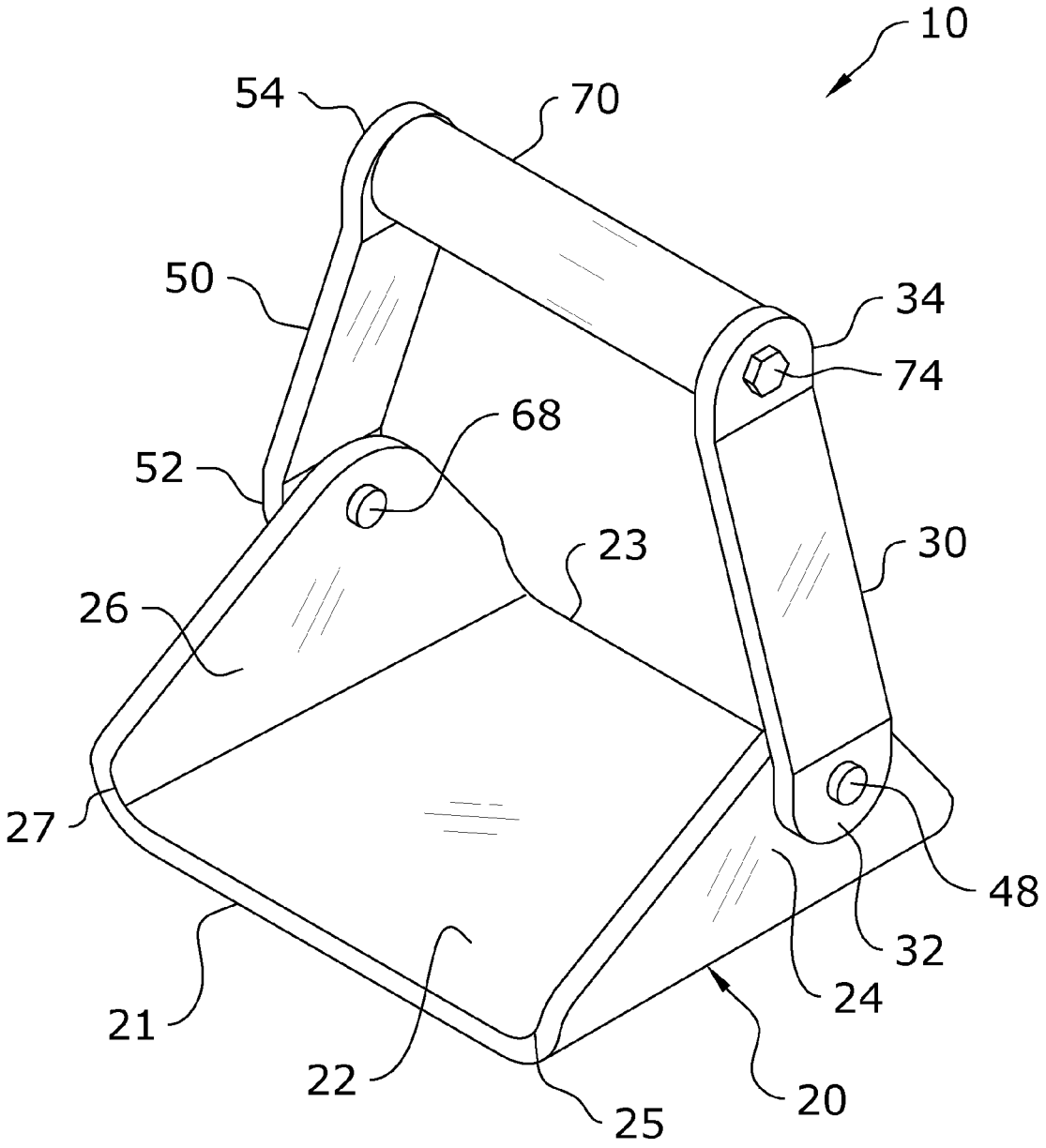
FIG. 1 is a rear upper perspective view of the present invention.

A. Overview.

Turning now descriptively to the drawings, in which similar reference characters denote similar elements throughout the several views, FIGS. 1 through 8*b* illustrate a pivoting stirrup system 10, which comprises a foot support 20 having a rear end 21, a front end 23, a first sidewall 24 extending upwardly from a first side of the foot support 20 and a second sidewall 26 extending upwardly from a second side of the foot support 20, a first member 30 pivotally connected to the first sidewall 24 and a second member 50 pivotally connected to the second sidewall 26. The first member 30 and the second member 50 are pivotally connected to a forward portion of the respective sidewalls. A first fastener 48 extends through the first member 30 and the first sidewall 24 with a first bushing 40 positioned upon the first fastener 48 and a second fastener 68 extends through the second member 50 and the second sidewall 26 with a second bushing 60 positioned upon the second fastener 68. The bushings are comprised of a resilient material to provide for a controlled and smooth pivoting motion of the foot support 20 with respect to the first member 30 and second member 50. The foot support 20 preferably is comprised of a U-shaped cross sectional shape.

B. Foot Support.

FIGS. 1 through 8b illustrate the foot support 20 having a rear end 21, a front end 23, an upper surface 22 and a lower surface. The foot support 20 is preferably comprised of a rigid and non-flexible material such as but not limited to metal or plastic. The foot support 20, the first sidewall 24 and the second sidewall 26 are preferably comprised of the same rigid and lightweight material type. The applicant has found that aluminum is a desirable material because of the reduced weight and strength. However, various other materials may be utilized to construct the foot support 20 and the sidewalls 24, 26.

Figure 2:
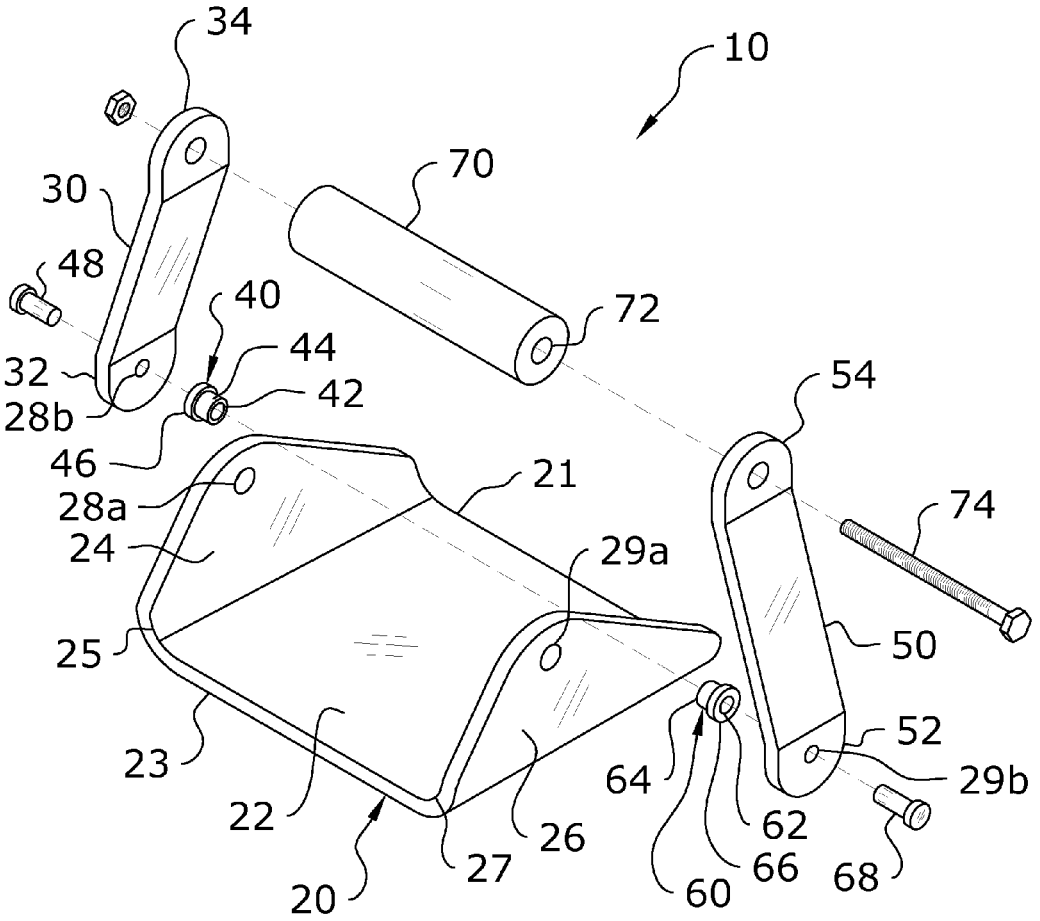
FIG. 2 is an exploded front upper perspective view of the present invention.
Figure 3:
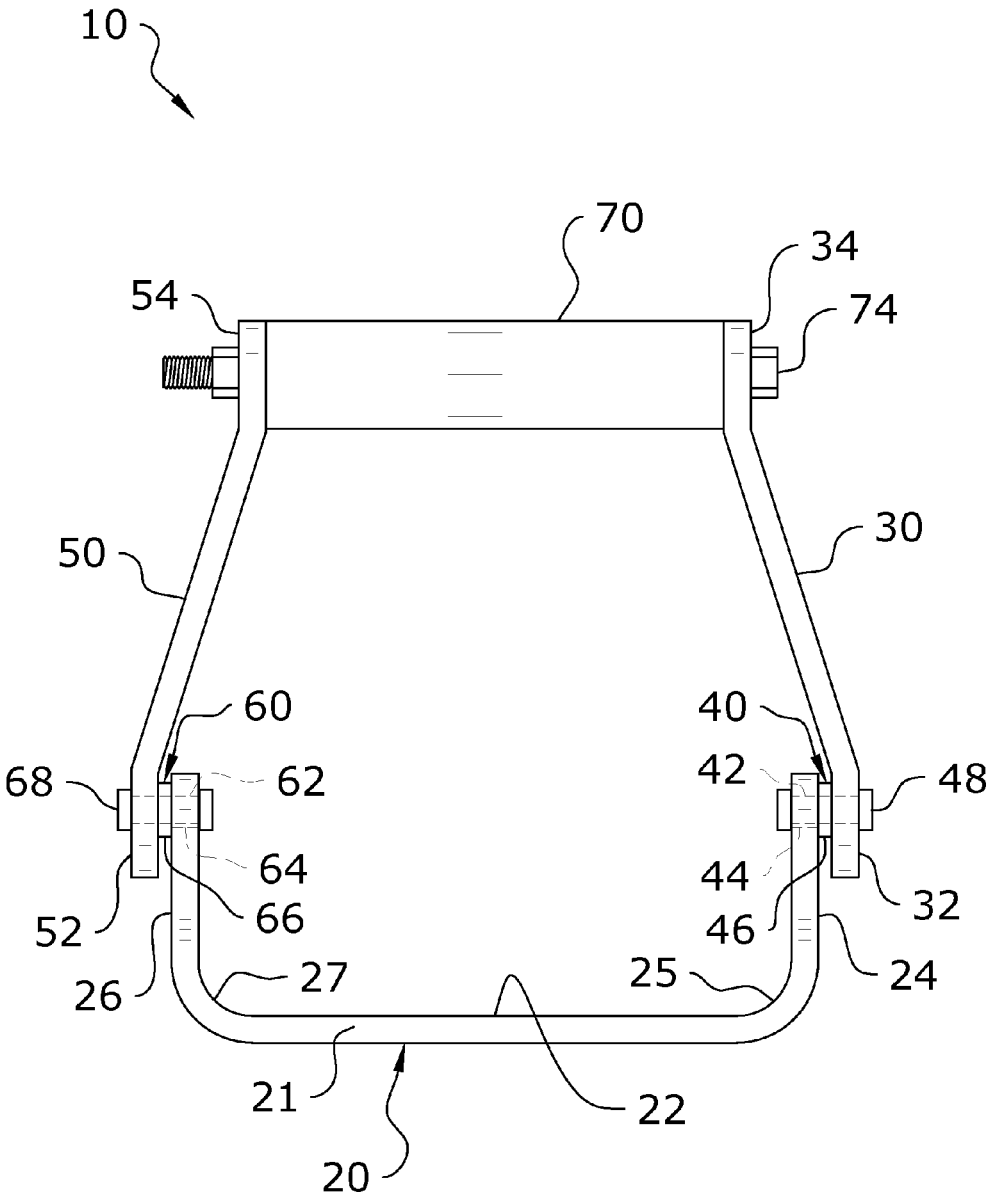
FIG. 3 is a rear view of the present invention.

A first sidewall 24 extends upwardly from a first side of the foot support 20 and a second sidewall 26 extends upwardly from a second side of the foot support 20 as best illustrated in FIGS. 1, 2 and 3 of the drawings. The first side is positioned opposite of the second side of the foot support 20 as best illustrated in FIG. 3 of the drawings based on the respective positions of the sidewalls 24, 26.

The foot support 20 is preferably comprised of a broad structure to provide a correspondingly broad upper surface 22 to support the bottom of the foot/shoe of the rider. In particular, the foot support 20 is preferably comprised of a broad structure having a planar and rectangular structure as illustrated in FIGS. 1, 2, 5 and 6 of the drawings. A length measured from the rear end 21 to the front end 23 of the foot support 20 is preferably at least five inches and further preferably is approximately six inches in length. It is further preferable that the length is approximately the same as a width of the foot support 20 wherein the width is measured from the first side to the second side of the foot support 20. The width of the foot support 20 is preferably approximately six inches to accommodate various sizes and types of shoes.

The first sidewall 24 and the second sidewall 26 are preferably integrally formed with the foot support 20 to form a unitary structure, however, the sidewalls 24, 26 may be attached to the foot support 20 with fasteners or via other attaching means such as welding. The first sidewall 24 preferably includes a first curved portion 25 connecting to the foot support 20 and the second sidewall 26 preferably includes a second curved portion 27 connecting to the foot support 20 as best illustrated in FIG. 3 of the drawings.

Figure 4:
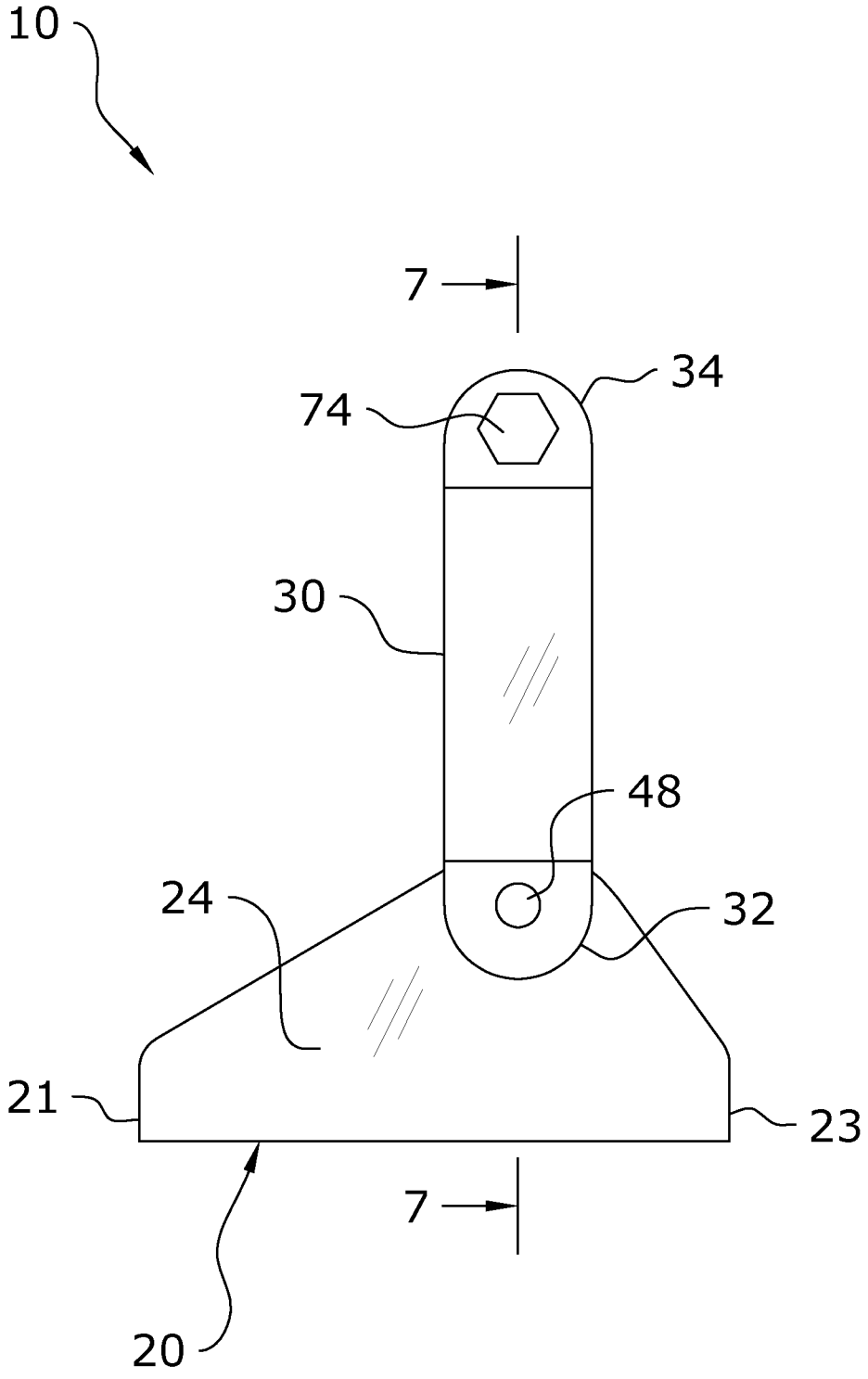
FIG. 4 is a right side view of the present invention.

The sidewalls 24, 26 preferably taper downwardly from near the pivot connections with the first member 30 and the second member 50 to the rear end 21 as illustrated in FIGS. 2 and 4 of the drawings. The sidewalls 24, 26 further preferably taper downwardly from near the pivot connections with the first member 30 and the second member 50 to the front end 23 as further illustrated in FIGS. 2 and 4 of the drawings. The sidewalls 24, 26 are preferably parallel with respect to one another and further preferably mirror one another as illustrated in FIGS. 1 through 3 of the drawings. The sidewalls 24, 26 are further preferably orthogonally positioned with respect to the upper surface 22 of the foot support 20 as illustrated in FIG. 3 of the drawings.

C. First and Second Members.

FIGS. 1 through 3 illustrate a first member 30 having a first upper end 34 and a first lower end 32. The first lower end 32 of the first member 30 is pivotally connected to the first sidewall 24 and is preferably connected to an upper portion of the first sidewall 24 as best illustrated in FIGS. 1 and 3 of the drawings. The first lower end 32 is preferably positioned on the outside of the first sidewall 24 to prevent engagement of the first member 30 with the foot and/or shoe of the rider during pivoting.

The first member 30 preferably is angled inwardly from the first lower end 32 to the first upper end 34 as illustrated in FIG. 3 of the drawings. The first lower end 32 is preferably parallel with respect to the first sidewall 24 and further is preferably parallel with the first upper end 34 as illustrated in FIG. 3 of the drawings. The first member 30 is preferably comprised of an elongated flat structure.

A first fastener 48 extends through a lower first aperture 28*b* within the first member 30 and a first aperture 28*a* within the first sidewall 24 to pivotally attached the first member 30 to the first sidewall 24 as illustrated in FIGS. 1 through 3 of the drawings. The first fastener 48 may be comprised of various types of fasteners such as but not limited to threaded bolts and nuts, rivets having an outer flanged end and an inner flanged end, pins and other types of fasteners capable of providing a pivot point for the foot support 20 with respect to the first member 30.

FIGS. 1 through 3 further illustrate a second member 50 having a second upper end 54 and a second lower end 52 positioned opposite of the first member 30. The second lower end 52 of the second member 50 is pivotally connected to the second sidewall 26 and is preferably connected to an upper portion of the second sidewall 26 as best illustrated in FIGS. 1 and 3 of the drawings. The second lower end 52 is preferably positioned on the outside of the second sidewall 26 to prevent engagement of the second member 50 with the foot and/or shoe of the rider during pivoting.

The second member 50 preferably is angled inwardly from the second lower end 52 to the second upper end 54 as illustrated in FIG. 3 of the drawings. The second lower end 52 is preferably parallel with respect to the second sidewall 26 and further is preferably parallel with the second upper end 54 as illustrated in FIG. 3 of the drawings. The second member 50 is preferably comprised of an elongated flat structure.

A second fastener 68 extends through a lower second aperture 29*b* within the second member 50 and a second aperture 29*a* within the second sidewall 26 to pivotally attached the second member 50 to the second sidewall 26 as illustrated in FIGS. 1 through 3 of the drawings. The second fastener 68 is preferably concentrically aligned with the first fastener 48 to provide a common pivot point for the foot support 20. The second fastener 68 may be comprised of various types of fasteners such as but not limited to threaded bolts and nuts, rivets having an outer flanged end and an inner flanged end, pins and other types of fasteners capable of providing a pivot point for the foot support 20 with respect to the second member 50.

The first member 30 and the second member 50 are preferably connected to the first sidewall 24 and the second sidewall 26 respectively at a pivot point between a center point of the foot support 20 and the front end 23 as best illustrated in FIG. 4 of the drawings. In particular, the pivot point is preferably closer to the center point of the foot support 20. For example, if the length of the foot support 20 from the rear end 21 to the front end 23 is six inches, the pivot point is preferably located at approximately 3.75 inches from the rear end 21 or approximately 2.25 inches from the front end 23.

The first member 30 and the second member 50 preferably mirror one another when pivotally connected to the foot support 20. In addition, the first member 30 and the second member 50 are each preferably at least seven inches in length. Furthermore, the first member 30 and the second member 50 pivotally support the foot support 20 upon a pivot axis that is transverse with respect to a longitudinal axis that extends from the rear end 21 to the front end 23 of the foot support 20 so the rider can pivot the foot support 20 forwardly or rearwardly upon the pivot axis.

The first apertures 28*a*, 28*b* and the second apertures 29*a*, 29*b* are preferably concentrically aligned with one another to correspondingly align the first fastener 48 and the second fastener 68 with respect to one another. The first apertures 28*a*, 28*b* and the second apertures 29*a*, 29*b* are positioned above an upper surface 22 of the foot support 20 a distance less than half a length of the foot support 20 measured from the rear end 21 to the front end 23. However, the first apertures 28*a*, 28*b* and the second apertures 29*a*, 29*b* are preferably positioned above the 22 of the foot support 20 at least two inches or more.

D. Upper Support Member.

Figure 5:
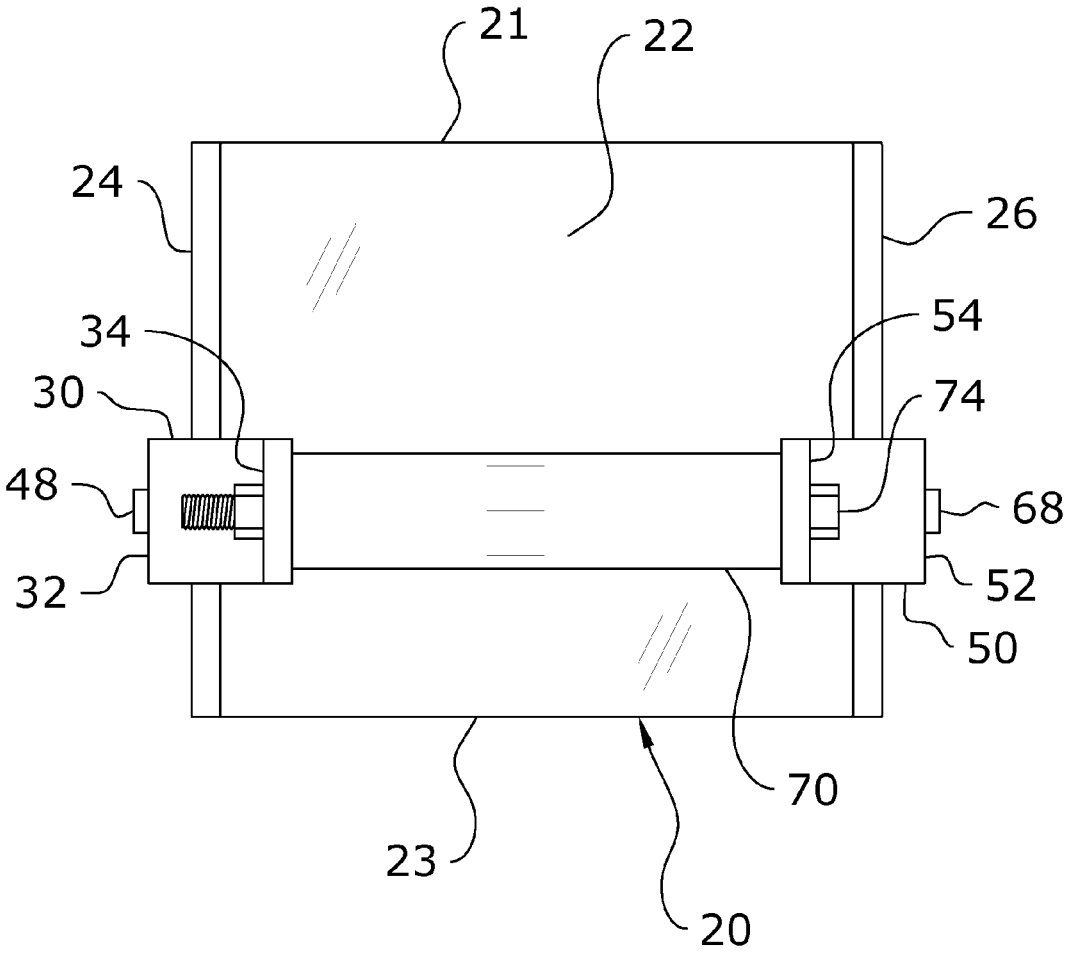
FIG. 5 is a top view of the present invention.
Figure 6:
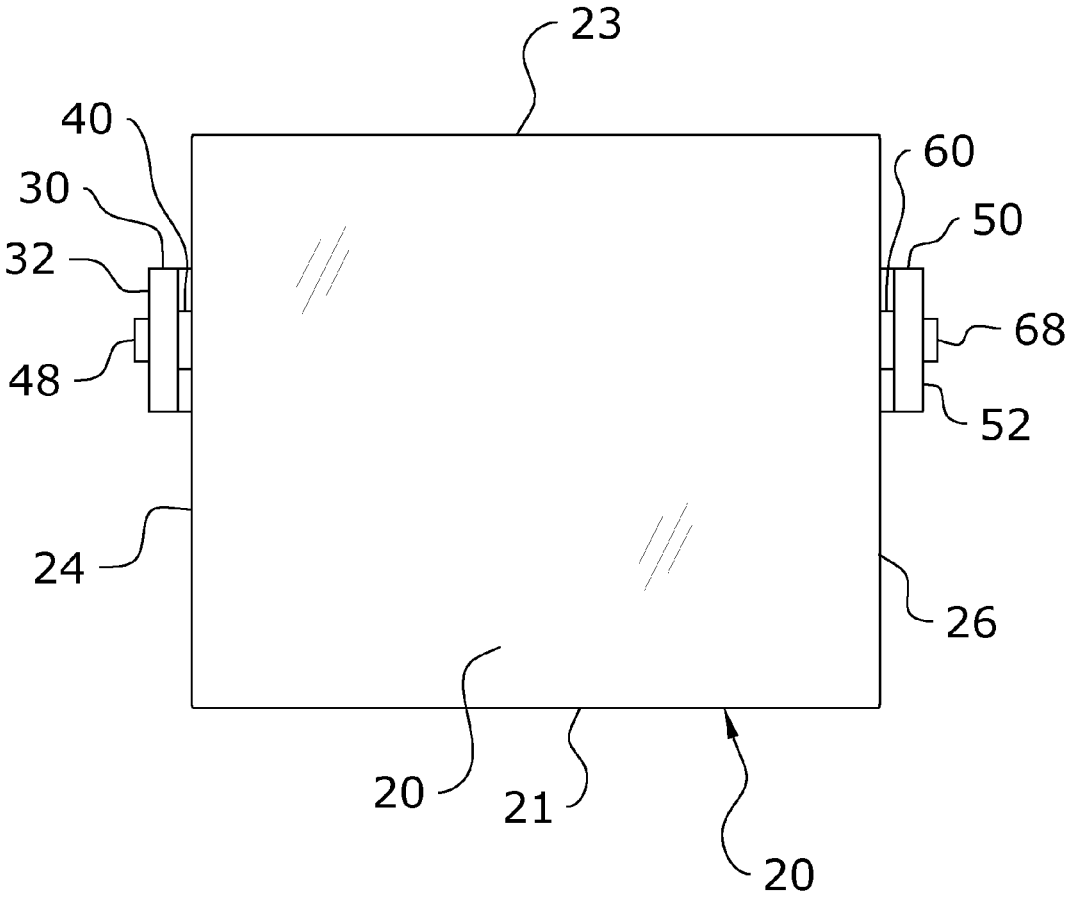
FIG. 6 is a bottom view of the present invention.

The upper support member 70 is connected between the first upper end 34 and the second upper end 54 as shown in FIGS. 1 and 5 of the drawings. The upper support member 70 is comprised of a tubular structure having a longitudinal aperture 72 extending through the upper support member 70 in a longitudinal manner. An upper fastener 74 extends through a first upper aperture within the first upper end 34 of the first member 30, the longitudinal aperture 72 within the upper support member 70 and a second upper aperture within the second upper end 54 of the second member 50 as further illustrated in FIGS. 1 through 3 and 5 and 7 of the drawings. The length of the upper support member 70 is preferably less than the width of the foot support 20 as shown in FIG. 3 of the drawings. The upper support member 70 is preferably comprised of a circular cross sectional shape to be receive within a strap 12 connected to the saddle in a pivoting manner along an upper pivot axis. The upper pivot axis is preferably parallel with respect to the pivot axis of the foot support 20.

E. First and Second Bushings.

The first bushing 40 and the second bushing 60 are preferably comprised of a resilient material that provides comfortable and smooth movement of the foot support 20 about the pivot axis. In particular, the first bushing 40 and the second bushing 60 preferably provide a slight resistance to the pivoting movement and reduce noise by preventing the members 30, 50 from directly contacting the sidewalls 24, 26 particularly when constructed of a metal material. It is preferable that the first bushing 40 and the second bushing 60 are comprised of a non-metal material that is resilient such as a plastic material. The first bushing 40 and the second bushing 60 are preferably comprised of the same structure, material and configuration. The first bushing 40 and the second bushing 60 are preferably concentrically aligned with one another when attached to the present invention.

Figure 7:
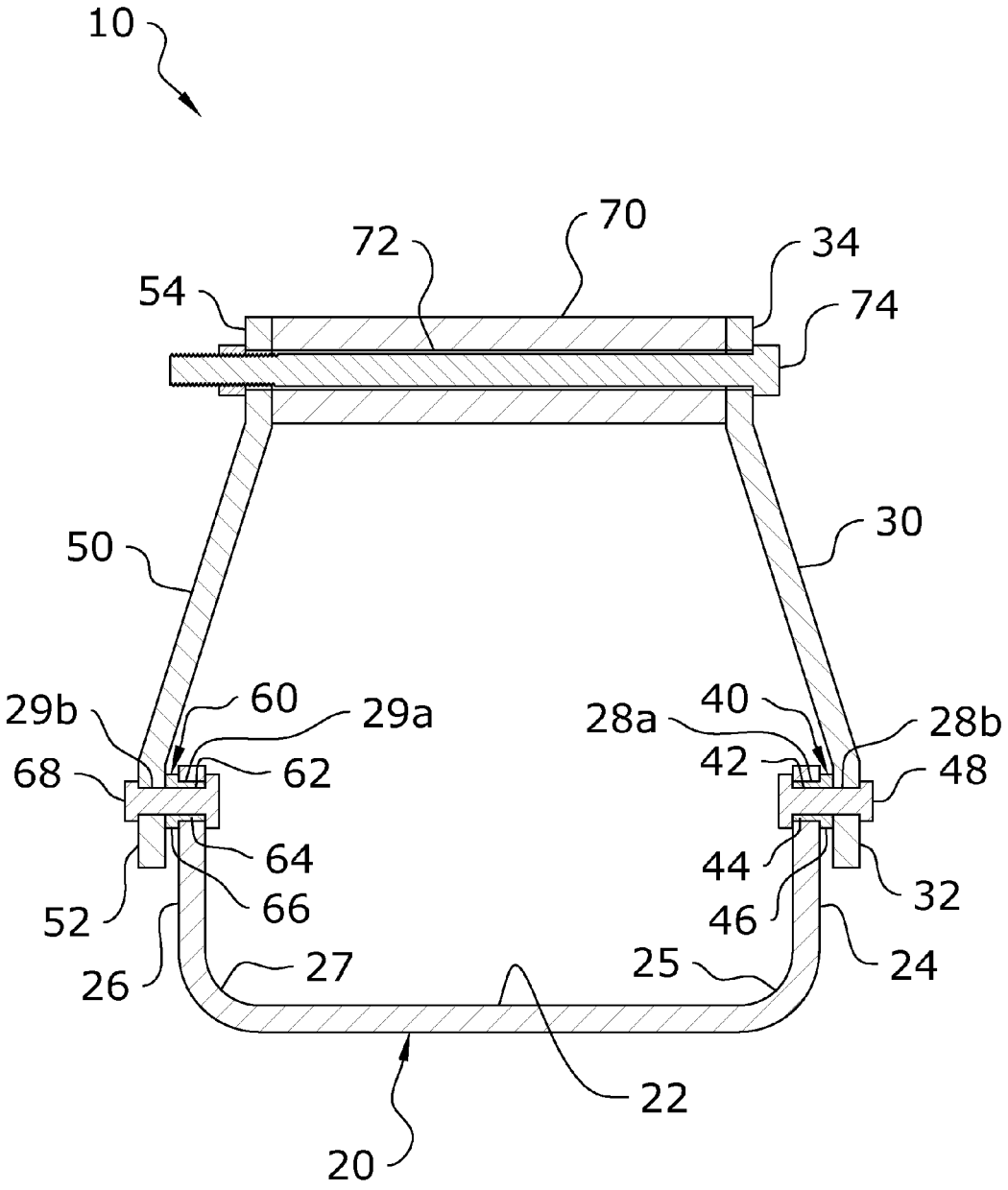
FIG. 7 is a cross sectional view taken along line 7-7 of FIG. 4.

The first bushing 40 is positioned upon the first fastener 48 so as to separate the first lower end 32 of the first member 30 from the first sidewall 24. The first bushing 40 further preferably separates the first fastener 48 from directly contacting the foot support 20. The first bushing 40 is preferably comprised of a first extended portion 44 that extends into the first aperture 28*a* of the first sidewall 24 as illustrated in FIG. 7. The first extended portion 44 is comprised of a tubular structure that has an outer diameter that is approximately the same as the inner diameter of the first aperture 28*a*. The first bushing 40 further includes a first flange portion 46 attached to an outside portion of the first extended portion 44 and is transverse with respect to the first extended portion 44. The first flange portion 46 is positioned between the first lower end 32 of the first member 30 and the first sidewall 24 as best illustrated in FIG. 7 of the drawings. A first opening 42 extends through the first extended portion 44 and the first flange portion 46 that receives the first fastener 48.

The second bushing 60 is positioned upon the second fastener 68 so as to separate the second lower end 52 of the second member 50 from the second sidewall 26 similar to the first bushing 40 with respect to the first member 30 and the first sidewall 24. The second bushing 60 further preferably separates the second fastener 68 from directly contacting the foot support 20. The second bushing 60 is preferably comprised of a second extended portion 64 that extends into the second aperture 29*a* of the second sidewall 26 as illustrated in FIG. 7. The second extended portion 64 is comprised of a tubular structure that has an outer diameter that is approximately the same as the inner diameter of the second aperture 29*a*. The second bushing 60 further includes a second flange portion 66 attached to an outside portion of the second extended portion 64 and is transverse with respect to the second extended portion 64. The second flange portion 66 is positioned between the second lower end 52 of the second member 50 and the second sidewall 26 as best illustrated in FIG. 7 of the drawings. A second opening 62 extends through the second extended portion 64 and the second flange portion 66 that receives the second fastener 68.

F. Operation of Preferred Embodiment.

Figure 8A:
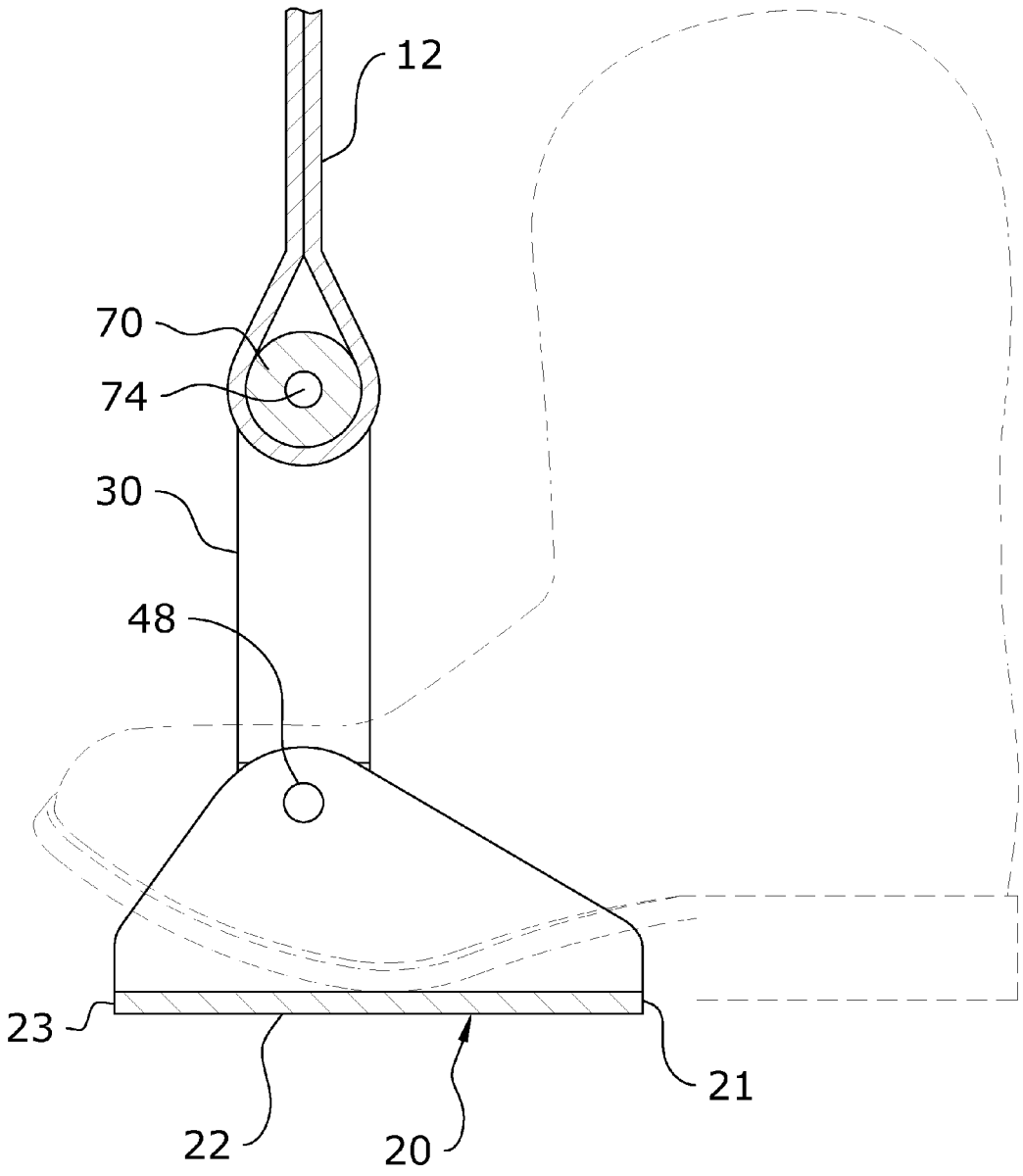
FIG. 8*a* is a left side cutaway view showing the boot of a rider positioned upon the foot support of the present invention.
Figure 8B:
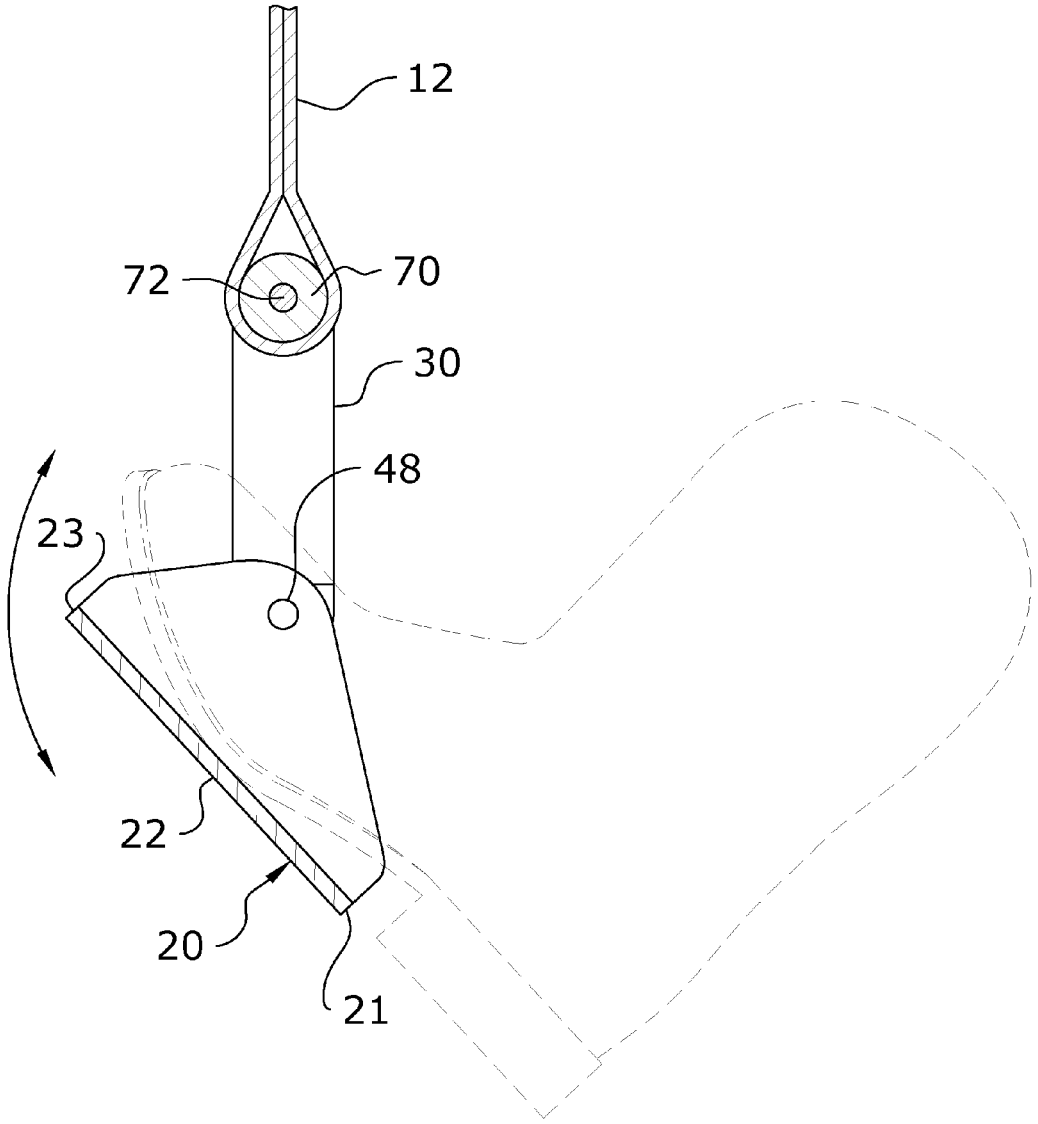
FIG. 8*b* is a left side cutaway view showing the boot of the rider positioned upon the foot support pivoted downwardly for dismounting.

In use, the user attaches the present invention in pairs to a saddle with one attached to a left side of the saddle and another attached to the right side of the saddle. The user attaches the invention to the straps 12 of the saddle as illustrated in FIGS. 8*a* and 8*b* of the drawings. Once connected to the saddle, the user is able to mount the animal by positioning their foot upon the upper surface 22 of the foot support 20 with the foot support 20 pivoting rearwardly to accommodate the angle of the foot during the initial mounting as shown in FIG. 8*b*. Once the user has mounted the animal and is positioned within the riding position in the saddle, the foot support 20 is generally horizontal except to accommodate various movements of the foot/shoe of the rider while riding to provide a comfortable ride. The bushings 40, 60 provide a consistent and smooth pivoting movement of the foot support 20 with sufficient resistance to prevent free movement while still allowing pivoting movement by the foot. When the user is finished riding and begins to dismount the animal, the weight of the user is placed towards the rear portion of the foot support 20 causing the foot support 20 to pivot rearwardly thereby allowing the foot to be easily removed from the foot support 20 without obstruction or hang-up as shown in FIG. 8*b* of the drawings.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A pivoting stirrup, comprising:

a foot support having a rear end, a front end, a first sidewall extending upwardly from a first side of said foot support and a second sidewall extending upwardly from a second side of said foot support, wherein said first side is positioned opposite of said second side;

a first member having a first upper end and a first lower end, wherein said first lower end of said first member is pivotally connected to said first sidewall;

a second member having a second upper end and a second lower end, wherein said second lower end of said second member is pivotally connected to said second sidewall;

a first fastener extending through a lower first aperture within said first member and a first aperture within said first sidewall, and a second fastener extending through a lower second aperture within said second member and a second aperture within said second sidewall; and a first bushing positioned upon said first fastener and a second bushing positioned upon said second fastener;

wherein said first bushing is comprised of a first extended portion that extends into said first aperture of said first sidewall, a first flange portion attached to an outside portion of said first extended portion, wherein said first flange portion is positioned between said first lower end of said first member and said first sidewall, and a first opening extending through said first extended portion and said first flange portion that receives said first fastener, and wherein said second bushing is comprised of a second extended portion that extends into said second aperture of said second sidewall, a second flange portion attached to an outside portion of said second extended portion, wherein said second flange portion is positioned between said second lower end of said second member and said second sidewall, and a second opening extending through said second extended portion and said second flange portion that receives said second fastener.

2. The pivoting stirrup of claim 1, including an upper support member connected between said first upper end and said second upper end.

3. The pivoting stirrup of claim 2, wherein said upper support member is comprised of a tubular structure having a longitudinal aperture extending through said upper support member in a longitudinal manner.

4. The pivoting stirrup of claim 3, including an upper fastener extending through a first upper aperture within said first upper end of said first member, said longitudinal aperture within said upper support member and a second upper aperture within said second upper end of said second member.

5. The pivoting stirrup of claim 1, wherein said foot support is comprised of a broad planar structure.

6. The pivoting stirrup of claim 1, wherein said foot support is comprised of a rectangular structure.

7. The pivoting stirrup of claim 1, wherein a length from said rear end to said front end of said foot support is at least five inches.

8. The pivoting stirrup of claim 7, wherein said length is approximately the same as a width of said foot support.

9. The pivoting stirrup of claim 1, wherein said first sidewall and said second sidewall are integrally formed with said foot support to form a unitary structure.

10. The pivoting stirrup of claim 9, wherein said foot support, said first sidewall and said second sidewall are comprised of an aluminum material.

11. The pivoting stirrup of claim 9, wherein said first sidewall includes a first curved portion connecting to said foot support and wherein said second sidewall includes a second curved portion connecting to said foot support.

12. The pivoting stirrup of claim 1, wherein said first member and said second member are connected to said first sidewall and said second sidewall respectively at a pivot point between a center point of said foot support and said front end.

13. The pivoting stirrup of claim 12, wherein said pivot point is closer to said center point of said foot support than to said front end.

14. The pivoting stirrup of claim 1, wherein said first aperture and said second aperture are concentrically aligned with one another.

15. The pivoting stirrup of claim 1, wherein said first aperture and said second aperture are positioned above an upper surface of said foot support a distance less than half a length of said foot support measured from said rear end to said front end.

16. The pivoting stirrup of claim 1, wherein said first bushing and said second bushing are comprised of a plastic material.

17. A pivoting stirrup, comprising:

a foot support having a rear end, a front end, a first sidewall extending upwardly from a first side of said foot support and a second sidewall extending upwardly from a second side of said foot support, wherein said first side is positioned opposite of said second side;

wherein said foot support is comprised of a broad planar and rectangular structure;

wherein a length from said rear end to said front end of said foot support is at least five inches;

wherein said length is approximately the same as a width of said foot support;

wherein said first sidewall and said second sidewall are integrally formed with said foot support to form a unitary structure;

wherein said foot support, said first sidewall and said second sidewall are comprised of an aluminum material;

wherein said first sidewall includes a first curved portion connecting to said foot support and wherein said second sidewall includes a second curved portion connecting to said foot support;

a first member having a first upper end and a first lower end, wherein said first lower end of said first member is pivotally connected to said first sidewall;

a second member having a second upper end and a second lower end, wherein said second lower end of said second member is pivotally connected to said second sidewall;

an upper support member connected between said first upper end and said second upper end, wherein said upper support member is comprised of a tubular structure having a longitudinal aperture extending through said upper support member in a longitudinal manner;

an upper fastener extending through a first upper aperture within said first upper end of said first member, said longitudinal aperture within said upper support member and a second upper aperture within said second upper end of said second member;

wherein said first member and said second member are connected to said first sidewall and said second sidewall respectively at a pivot point between a center point of said foot support and said front end, wherein said pivot point is closer to said center point of said foot support than to said front end;

a first fastener extending through a lower first aperture within said first member and a first aperture within said first sidewall;

a second fastener extending through a lower second aperture within said second member and a second aperture within said second sidewall;

wherein said first aperture and said second aperture are concentrically aligned with one another;

wherein said first aperture and said second aperture are positioned above an upper surface of said foot support a distance less than half a length of said foot support measured from said rear end to said front end;

a first bushing positioned upon said first fastener, wherein said first bushing is comprised of a first extended portion that extends into said first aperture of said first sidewall, a first flange portion attached to an outside portion of said first extended portion, wherein said first flange portion is positioned between said first lower end of said first member and said first sidewall, and a first opening extending through said first extended portion and said first flange portion that receives said first fastener; and a second bushing positioned upon said second fastener, wherein said second bushing is comprised of a second extended portion that extends into said second aperture of said second sidewall, a second flange portion attached to an outside portion of said second extended portion, wherein said second flange portion is positioned between said second lower end of said second member and said second sidewall, and a second opening extending through said second extended portion and said second flange portion that receives said second fastener;

wherein said first bushing and said second bushing are comprised of a plastic material.

* * * * *